US008075815B2

(12) United States Patent
Aderhold

(10) Patent No.: US 8,075,815 B2
(45) Date of Patent: Dec. 13, 2011

(54) METHOD FOR THE DETECTION OF PROCESS PARAMETERS, AND WOOD PRODUCT

(75) Inventor: Jochen Aderhold, Wennigsen (DE)

(73) Assignee: Fraunhofer-Gesellschaft zur Forderung der Angewandten Forschung E.V., Munich (DE)

( * ) Notice: Subject to any disclaimer, the term of this patent is extended or adjusted under 35 U.S.C. 154(b) by 26 days.

(21) Appl. No.: 12/663,059

(22) PCT Filed: Jun. 3, 2008

(86) PCT No.: PCT/DE2008/000932

§ 371 (c)(1),
(2), (4) Date: Dec. 4, 2009

(87) PCT Pub. No.: WO2008/148380

PCT Pub. Date: Dec. 11, 2008

(65) Prior Publication Data

US 2010/0164132 A1 Jul. 1, 2010

(30) Foreign Application Priority Data

Jun. 4, 2007 (DE) ..... 10 2007 026 155

(51) Int. Cl.
*B27N 3/18* (2006.01)

(52) U.S. Cl. ..... 264/40.1; 264/320; 425/144; 425/149

(58) Field of Classification Search ..... 264/40.1, 264/299, 319, 320; 425/149, 170, 143–144
See application file for complete search history.

(56) References Cited

U.S. PATENT DOCUMENTS

| | | | | |
|---|---|---|---|---|
| 4,313,899 | A * | 2/1982 | Hain | 264/40.1 |
| 6,180,257 | B1 * | 1/2001 | Brandt et al. | 428/532 |
| 6,494,991 | B1 * | 12/2002 | Palmer et al. | 162/181.6 |
| 6,784,671 | B2 * | 8/2004 | Steele et al. | 324/640 |
| 6,872,442 | B2 * | 3/2005 | Yajima et al. | 428/188 |
| 7,405,656 | B2 * | 7/2008 | Olsen | 340/572.1 |
| 2002/0140121 | A1 * | 10/2002 | von Haas | 264/40.1 |
| 2002/0186649 | A1 * | 12/2002 | Feist et al. | 369/280 |
| 2003/0146767 | A1 * | 8/2003 | Steele et al. | 324/640 |
| 2005/0053684 | A1 | 3/2005 | Ptischeneder | |

(Continued)

FOREIGN PATENT DOCUMENTS

DE 102 56 312 12/2002

(Continued)

OTHER PUBLICATIONS

German Office Action.

*Primary Examiner* — Joseph Del Sole
*Assistant Examiner* — Nahida Sultana
(74) *Attorney, Agent, or Firm* — Whitham Curtis Christofferson & Cook, PC

(57) ABSTRACT

The invention relates to a method for detecting process parameters when making wood products (6), especially wood panels, which are hot-pressed by applying pressure and heat, as well as a wood product (6). In said method, at least one measuring instrument (3) is introduced into the non-pressed starting material (2) during the on-going production process of the wood products (6) in order to detect the pressure, temperature, and/or humidity and remains in the end product (6). The measured process parameters are read in a wireless manner.

7 Claims, 1 Drawing Sheet

U.S. PATENT DOCUMENTS

| | | | | |
|---|---|---|---|---|
| 2005/0248047 | A1* | 11/2005 | Gupta | 264/40.1 |
| 2006/0216471 | A1* | 9/2006 | Grah et al. | 428/137 |
| 2006/0234398 | A1 | 10/2006 | Gluschenkov | |
| 2006/0238307 | A1* | 10/2006 | Bauer et al. | 340/10.1 |
| 2007/0157994 | A1* | 7/2007 | Scoville et al. | 144/380 |
| 2008/0152861 | A1* | 6/2008 | Barker | 428/106 |
| 2008/0275327 | A1* | 11/2008 | Faarbaek et al. | 600/382 |

FOREIGN PATENT DOCUMENTS

| | | |
|---|---|---|
| FI | 7 351 | 1/2007 |
| NL | 1 029 796 | 2/2007 |
| WO | WO 2006/068688 | 6/2006 |
| WO | WO 2008/034948 | 3/2008 |

* cited by examiner

METHOD FOR THE DETECTION OF PROCESS PARAMETERS, AND WOOD PRODUCT

The invention relates to a method for detecting process parameters during the production of wood products, in particular wood boards, which are hot-pressed with the application of pressure and the supply of heat.

Wood products, for example oriented strand boards (OSB), chipboards, MDF or HDF boards, can be produced in different ways; in addition to a short-cycle press, continuous pressing methods using heated press belts can be provided in order to press the strands, chips or fibers provided with adhesive agents, such as glue, adhesive or resins, to form wood products, in particular wood boards. Both the short-cycle pressing and what is known as continuous pressing consolidate the chip or fiber cake or the scattered fibers, chips or strands and, by means of the heated press plates or press belts, activate the adhesive agents, so that the strands, chips or fibers form a permanent bond with one another.

The production operation of such wood products is subjected to a large number of parameters, for example the scattering density, the moisture of the starting material, the level of gluing or uniformity of the scattering behavior and the orientation of the starting materials so that, for the optimum performance of the hot pressing of wood materials to produce wood products, the knowledge of process parameters, such as temperature, pressure and moisture, within the wood products is important. In particular, it is important that, during the pressing operation, in particular in the case of continuous process sequences, the data is available in order to be able to make control interventions.

One possible way of checking the process parameters consists in checking the finished product immediately at the output from the press. In the case of continuous fabrication methods, samples would have to be removed in a very complicated manner for this purpose. Likewise, no knowledge of the parameters during the pressing operation can be obtained as a result.

Furthermore, it has been proposed to insert measuring instruments into the material to be pressed and to press them, these measuring instruments being wire-bound and connected to an evaluation unit. These measuring instruments are very large and cannot be used in the continuous production process without interrupting the latter. Furthermore, these measuring instruments have to be removed again following the pressing of the wood products, which means that the wood products can no longer be used. The removal of the measuring instruments is complicated and generally destroys the wood product. Furthermore, the production process has to be interrupted in order to remove the measuring instrument.

US 2005/053684 A1 describes an injection molding apparatus in which, before the injection molding process, a transponder is introduced into the mold and transmits data about the injection molding operation to an evaluation device. After being introduced, the transponder remains in the end product.

WO 2008/034948 A1 describes a wood board made of a plurality of layers bonded to one another, between which an RFID unit is arranged. The RFID unit can have a sensor.

It is an object of the present invention to provide a method and a wood product with which, during the production of the wood product, relevant process parameters can be determined and provided for the control of the production process. According to the invention, this object is achieved by a method having the features of claim 1.

The method according to the invention for detecting process parameters during the production of wood products, in particular of wood boards, which are hot-pressed with the application of pressure and the supply of heat, provides for at least one measuring device for detecting pressure, temperature and/or moisture to be introduced into the unpressed starting material in the running production process and to remain in the end product, and for the measured process parameters to be read out wirelessly. By means of the present method, it is possible to dispense completely with the removal of the measuring devices once introduced. Only relatively small measuring devices or measuring instruments have to be introduced into the board, which necessitates only minimum intervention in the production process. The measuring instruments are miniaturized on the basis of the available methods of microelectronics and micromechanics, in such a way that, firstly, they can be left in the product without impairment to the product quality and, secondly, they are available inexpensively in sufficient quantity, so that no removal of the measuring instruments from the finished products is necessary on economic grounds.

The measuring device is able to store the process parameters, so that a change in the process parameters can be followed over the course of time. In this case, the measuring device is configured in such a way that the process parameters are detected over the entire hot-pressing operation and possibly stored, the entire hot-pressing operation beginning with the scattering and also possibly including the cooling of the finished products.

The measuring device can be provided with a transmitting device, so that, after the measurement of the process parameters, these can be transmitted actively. As an alternative to this, the measuring device can be constructed as a "transducer", so that the measured and possibly stored process parameters can be transmitted upon request.

In order to be able to provide a precise time window for the detection of the process parameters, provision is made for the measuring device to be activated before the hot-pressing operation, so that a starting point for the evaluation of the process parameters is defined. Provision can likewise be made for deactivation of the measuring device to be carried out at a desired, defined time or process stage.

The wood product, in particular the wood board, which is produced from hot-pressed wood materials, provides for a measuring device to be introduced into the wood product, the measuring device transmitting the process parameters wirelessly to an external reading unit. The measuring device can be constructed as a "transducer" or equipped with an active, automatically transmitting unit, in order to transmit the process parameters or measured data which have been determined during the hot-pressing operation to an external reading unit. The measuring device is able to store the process parameters, so that no immediate transmission of the data to the evaluation or reading unit has to be carried out.

An exemplary embodiment of the invention will be explained in more detail below by using the appended figures, in which.

Figure 1:
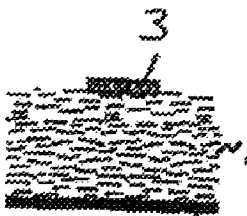
FIG. 1 shows a measuring device on a layer of glued chips or fibers.

FIG. 1 illustrates a first stage in the production of a wood product, a wood board in the present case, in which a first layer or ply of glued chips, strands or fibers 5 is scattered on a lower press plate 1. The strands, chips or fibers can also be produced as a mixture thereof. On this first layer of strands, fibers or chips 2, a measuring device 3 in the form of a miniaturized measuring sensor is placed or scattered, being capable of determining and, if necessary, recording the relevant process parameters such as pressure, temperature and moisture.

Figure 2:
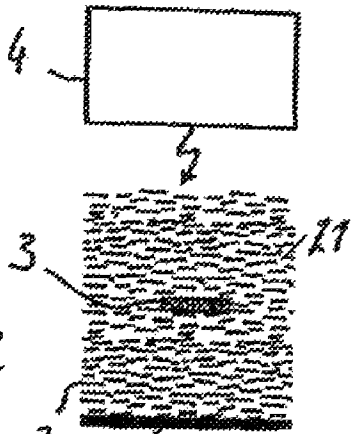
FIG. 2 shows an embedded measuring device during activation.

In the further process, which is shown in FIG. 2, a covering layer 21 is scattered onto the first layer 2 of the strands, chips or fibers, and is preferably formed from the same material or the same materials as the first layer 2. As a result, the measuring device 3 is embedded within the layer 2, 21 of the strands, fibers or chips; the measuring device 3 is thus completely enclosed and embedded in the chip or fiber cake. Provided above the measuring device 3 on the other side of the layer 21 of strands, chips or fibers is an activation unit 4, past which the measuring device 3 is guided. Alternatively, for this purpose the activation unit 4 can be led past the non-moving layer 2, 21 of strands, fibers or chips, in particular if, instead of a continuous fabrication process, the fabrication is carried out in a short-cycle press. Following activation of the measuring device 3, the latter begins to record the relevant process parameters.

Figure 3:
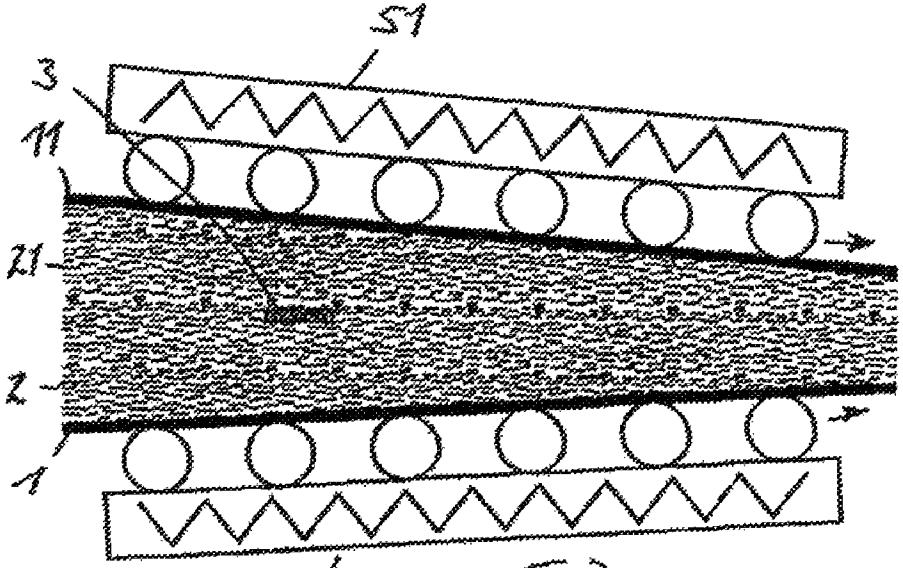
FIG. 3 shows a hot-pressing operation.

FIG. 3 shows an extract from a pressing operation, in which the layers 2, 21 of strands, chips or fibers, together with the measuring device 3, are enclosed between a lower press plate 1 and an upper press plate 11. The press plates 1, 11 are oriented at an angle to each other, so that the distance of the two press plates 1, 11 from each other decreases in the transport direction, which is indicated by the arrows. The press plates 1, 11 can be constructed as circulating press belts, which are driven and heated via rollers and heating devices 5, 51 so that, with the supply of pressure and heat, the wood materials 2, 21, which are coated or wetted with an adhesive, glue or the like, are pressed together to form an end product. Over the entire course of the pressing section, the determination, detection and possible storage of the process parameters, such as pressure, temperature and moisture, within the wood board being produced is carried out in the measuring device 3 and possibly transmitted to a reading and evaluation unit, not illustrated. If the measuring device 3 has a storage device, the reading of the data can also be carried out at a later time.

Figure 4:
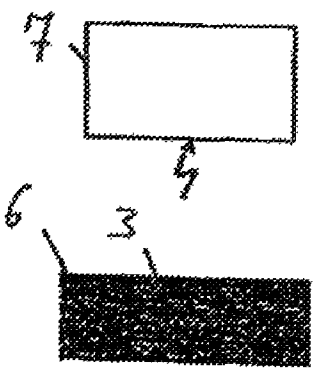
FIG. 4 shows an operation of reading the process data.

In FIG. 4, the finished wood product 6 is illustrated in a consolidated, compact configuration; the measuring device 3 is embedded in the core of the wood product 6, the wood board in the present case. The reader 7 is arranged above the measuring device 3 and receives the process parameters stored in the measuring device 3. The reading can be carried out immediately after the completion of the pressing operation; if appropriate a cooling operation can also be detected, so that the corresponding changes within the wood product 6 can be detected. The transmission and evaluation of the data from the measuring device 3 are carried out wirelessly, so that the measuring device 3, which has relatively small dimensions as compared with the wood product 6, can remain in the wood product 6. The measuring device can be constructed as "transducer", via which the data is read out on request, so that no individual energy supply for the transmission of the process data is needed. Likewise, there can be energy storage devices for active transmission of the process data within the measuring device 3, so that the process parameters determined can be read out simply.

Since the measuring devices 3 remain in the wood product 6, the pressure and, if appropriate, the moisture within the wood product 6 can also be detected and read out at a later time, so that detection and determination of the state of the wood product 6 during its use is possible.

The invention claimed is:

1. A method for detecting process parameters during the production of wood boards, which are hot-pressed with the application of pressure and the supply of heat, characterized in that strands, fibers or chips are scattered on as a starting material and at least one measuring device for detecting pressure, temperature and/or moisture is introduced into the unpressed starting material in a running production process and remains in an end product, and measured process parameters made during the running production process are read out wirelessly.

2. The method as claimed in claim 1, characterized in that the at least one measuring device stores the measured process parameters.

3. The method as claimed in claim 1, characterized in that the at least one measuring device detects and stores the measured process parameters over an entire hot-pressing operation.

4. The method as claimed in claim 1, characterized in that the at least one measuring device transmits the measured process parameters actively.

5. The method as claimed in claim 1, characterized in that the at least one measuring device is constructed as a transducer and transmits the measured process parameters on request.

6. The method as claimed in claim 1, characterized in that the at least one measuring device is activated before a hot-pressing operation.

7. The method as claimed in claim 5 wherein said measured process parameters are stored and transmitting transmits said measured process parameters from storage.

* * * * *